US007187132B2

(12) United States Patent
Bakre

(10) Patent No.: US 7,187,132 B2
(45) Date of Patent: Mar. 6, 2007

(54) BALLAST WITH FILAMENT HEATING CONTROL CIRCUIT

(75) Inventor: Shashank S. Bakre, Schaumburg, IL (US)

(73) Assignee: Osram Sylvania, Inc., Danvers, MA (US)

( * ) Notice: Subject to any disclaimer, the term of this patent is extended or adjusted under 35 U.S.C. 154(b) by 34 days.

(21) Appl. No.: 11/095,088

(22) Filed: Mar. 30, 2005

(65) Prior Publication Data

US 2006/0138968 A1 Jun. 29, 2006

Related U.S. Application Data

(60) Provisional application No. 60/639,422, filed on Dec. 27, 2004.

(51) Int. Cl.
*H05B 41/14* (2006.01)

(52) U.S. Cl. ..... 315/94; 315/209 R; 315/307; 315/DIG. 4; 315/DIG. 5

(58) Field of Classification Search ..... 315/94, 315/107, 244, 209 R, 224, 276, 291, 307, 315/DIG. 4, DIG. 7, DIG. 5
See application file for complete search history.

(56) References Cited

U.S. PATENT DOCUMENTS 6,348,769 B1 * 2/2002 Pinchuk et al. ..... 315/307
6,483,256 B2 * 11/2002 Heckmann ..... 315/224
6,531,831 B2 * 3/2003 Chou et al. ..... 315/225

* cited by examiner

*Primary Examiner*—Tuyet Vo
*Assistant Examiner*—Ephrem Alemu
(74) *Attorney, Agent, or Firm*—Fitch, Even, Tabin & Flannery; Kenneth D. Labudda

(57) ABSTRACT

A ballast (10) for powering at least one gas discharge lamp (20) having lamp filaments (22,24) comprises an inverter (200), an output circuit (300), a filament heating control circuit (400), and a dimming control circuit (500). Filament heating control circuit (400) is coupled to the dimming control circuit and at least one of the inverter and the output circuit. During operation, filament heating control circuit (400) controls the inverter and output circuit such that heating of the lamp filaments is provided during a preheat mode that occurs prior to ignition of the lamp, and during a dimming mode that optionally occurs after ignition of the lamp and that includes operating the lamp at a current level that is substantially less than a rated normal operating current of the lamp. No heating of the lamp filaments is provided during a full-light mode that occurs after ignition of the lamp and that includes operating the lamp at a current level that is substantially equal to the rated normal operating current of the lamp.

9 Claims, 2 Drawing Sheets

BALLAST WITH FILAMENT HEATING CONTROL CIRCUIT

STATEMENT OF RELATED APPLICATIONS

The present application claims priority to U.S. provisional patent application Ser. No. 60/639,422 (titled "Generating filament voltage during dimming with filament cut-off feature during full light level for electronic ballast," filed on Dec. 27, 2004), the disclosure of which is incorporated herein by reference.

The subject matter of the present application is related to that of U.S. patent application Ser. No. 11/010,845 (titled "Two Light Level Ballast," filed on Dec. 13, 2004, and assigned to the same assignee as the present invention), the disclosure of which is incorporated herein by reference.

FIELD OF THE INVENTION

The present invention relates to the general subject of circuits for powering discharge lamps. More particularly, the present invention relates to a ballast that includes a filament heating control circuit.

BACKGROUND OF THE INVENTION

Ballasts for gas discharge lamps are often classified into two groups according to how the lamps are ignited—preheat and instant start. In preheat ballasts, the lamp filaments are preheated at a relatively high level (e.g., 7 volts peak) for a limited period of time (e.g., one second or less) before a moderately high voltage (e.g., 500 volts peak) is applied across the lamp in order to ignite the lamp. In instant start ballasts, the lamp filaments are not preheated, so a higher starting voltage (e.g., 1000 volts peak) is required in order to ignite the lamp. It is generally acknowledged that instant start operation offers certain advantages, such as the ability to ignite the lamp at a lower ambient temperatures and greater energy efficiency (i.e., light output per watt) due to no expenditure of power on filament heating during normal operation of the lamp. On the other hand, instant start operation usually results in considerably lower lamp life than preheat operation.

Because a substantial amount of power is unnecessarily expended on heating the lamp filaments during normal operation of the lamp, it is desirable to have preheat-type ballasts in which filament power is minimized or eliminated once the lamp has ignited. Ballasts that provide filament preheating prior to lamp ignition, but that cease to provide filament heating after the lamp ignites, are commonly referred to as programmed start ballasts.

When a lamp is operated at a current level that approaches the rated normal operating current of the lamp (e.g., about 180 milliamperes rms for a T8 lamp), the absence of filament heating has little negative impact upon the useful operating life of the lamp. Thus, ordinary programmed start ballasts work well with lamps that are driven at a normal (i.e., full-light) level. Conversely, when a lamp is operated at a current level that is substantially less than the rated normal operating current of the lamp (i.e., such as what occurs when the lamp is operated in a dimmed mode), the absence of filament heating has been observed to have a considerable negative impact upon the useful operating life of the lamp. Thus, ordinary programmed start ballasts are not well suited for driving lamps at substantially reduced light levels.

Therefore, a need exists for a ballast that primarily operates in a programmed start manner (i.e., that provides filament heating prior to lamp ignition, and then no filament heating during full-light operation of the lamp), but that has an added feature of providing filament heating during dimmed operation of the lamp. Such a ballast would represent a significant advance over the prior art.

DETAILED DESCRIPTION OF THE PREFERRED EMBODIMENTS

Figure 1:
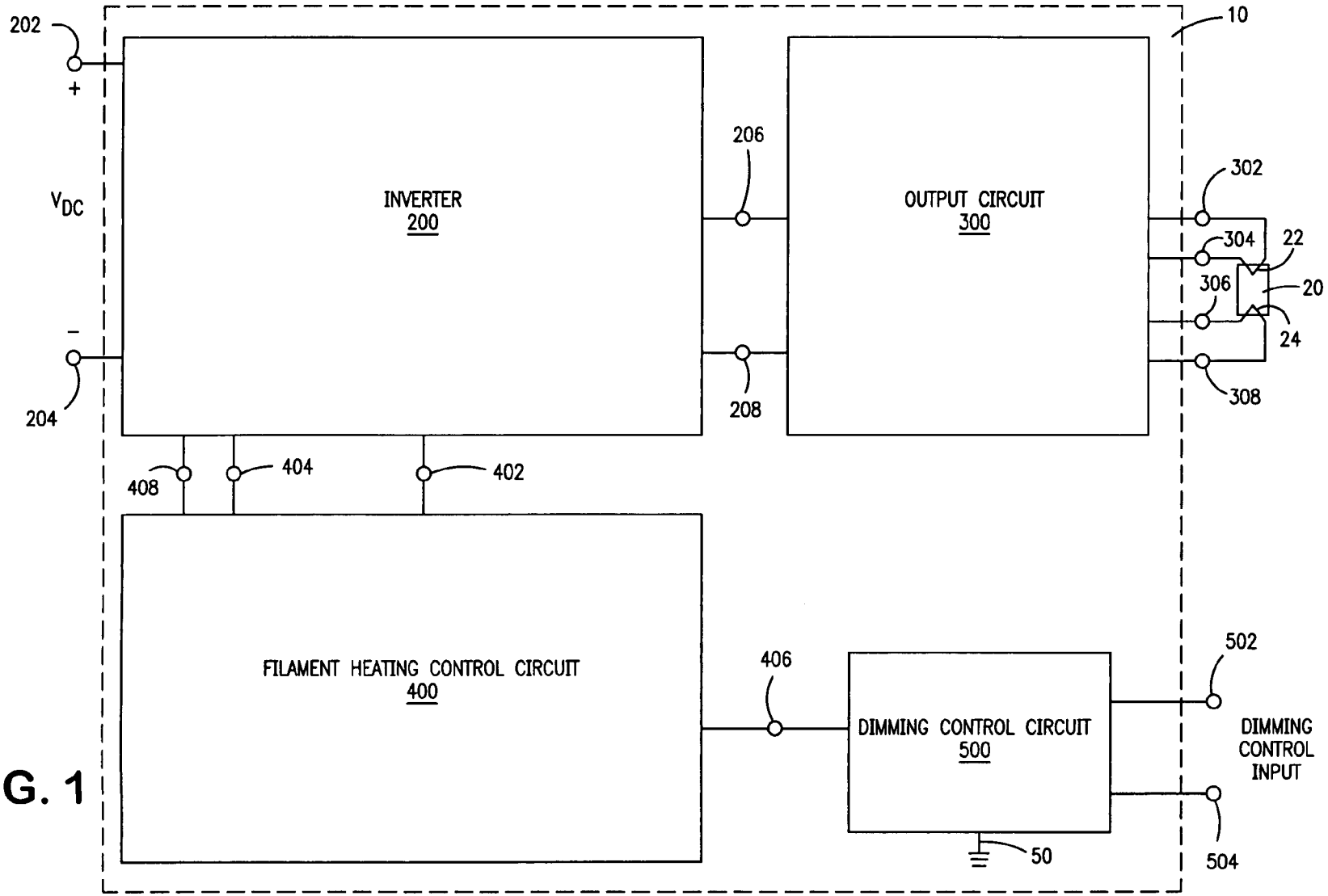
FIG. 1 is a block diagram schematic of an electronic ballast with a filament heating control circuit, in accordance with a preferred embodiment of the present invention.

FIG. 1 describes an electronic ballast 10 for powering at least one gas discharge lamp 20 having first and second lamp filaments 22,24. Ballast 10 comprises an inverter 200, an output circuit 300, a filament heating control circuit 400, and a dimming control circuit 500.

Inverter 200 has first and second input terminals 202,204, and first and second output terminals 206,208. Input terminals 202,204 are adapted to receive a source of substantially direct current (DC) voltage, $V_{DC}$, such as that which is commonly provided by a combination of a full-wave rectifier and boost converter that receive a conventional source of alternating current (AC) voltage (not shown), such as 120 volts rms at 60 hertz. During operation, inverter 200 preferably provides an alternating voltage between output terminals 206,208; preferably, the alternating voltage has a high frequency (i.e., 20,000 hertz or greater).

Output circuit 300 is coupled to inverter output terminals 206,208, and includes first, second, third, and fourth output connections 302,304,306,308 adapted for connection to lamp 20. More specifically, first and second output connections 302,304 are adapted for connection to first lamp filament 22, while third and fourth output connections 306,308 are adapted for connection to second lamp filament 24.

Dimming control circuit 500 includes a pair of input connections 502,504 adapted to receive a dimming control input. The dimming control input may be provided either by circuitry that is external to ballast 10 or by auxiliary circuitry that is internal to ballast 10. In one embodiment, the dimming control input signal is bi-modal, meaning that the signal has either a first value or a second value, with the first value indicating that lamp 20 should be operated in a non-dimmed mode with a full light output, and with the second value indicating that lamp 20 should be operating in a dimmed mode with a correspondingly reduced light output. An example of a dimming control circuit that is suitable for use in conjunction with ballast 10 is described in U.S. patent application Ser. No. 11/010,845 (titled "Two Light Level Ballast," filed on Dec. 13, 2004, and assigned to the same assignee as the present invention), the disclosure of which is incorporated herein by reference.

Figure 2:
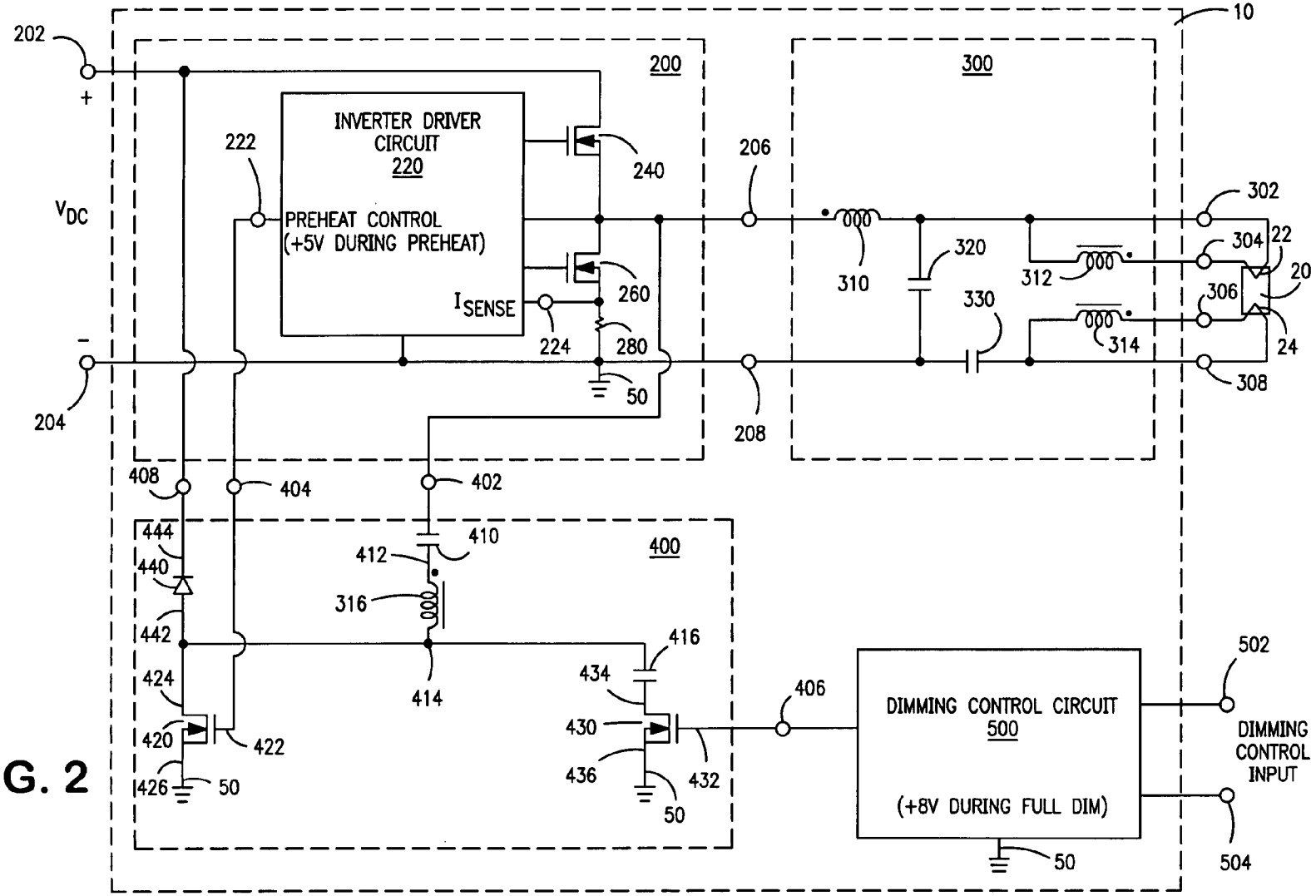
FIG. 2 is a detailed electrical schematic of an electronic ballast with a filament heating control circuit, in accordance with a preferred embodiment of the present invention.

Filament heating control circuit 400 is coupled to dimming control circuit 500 and at least one of inverter 200 and output circuit 300; in the preferred embodiment described in FIG. 2, filament heating control circuit 400 is electrically coupled to inverter 200, and magnetically coupled to output circuit 300. During operation, filament heating control circuit 400 controls inverter 200 and output circuit 300 such that heating of lamp filaments 22,24 is provided during a preheat mode and a dimming mode, but not during a full-light mode. The preheat mode occurs prior to ignition of lamp 20. During the preheat mode, lamp filaments 22,24 are heated at a first level (e.g., about 9 volts rms). The full-light mode occurs after ignition of lamp 20, and includes operating lamp 20 at a current level that is substantially equal to the rated normal operating current of lamp 20 (e.g., if lamp 20 is a T8 lamp, the rated normal operating current is about 180 milliamperes rms). During the full-light mode, lamp filaments 22,24 are not heated. The dimming mode occurs (if such a mode is desired) after ignition of lamp 20, and includes operating lamp 20 at a current level that is substantially less (e.g., 80 milliamperes rms) than the rated normal operating current of lamp 20. During the dimming mode, lamp filaments 22,23 are heated at a second level (e.g., about 6 volts rms).

Thus, ballast 10 conserves energy by not providing any heating of lamp filaments 22,24 when lamp 20 is operated in the full-light mode. Additionally, ballast 10 preserves the operating life of lamp 20 by providing heating of lamp filaments 22,24 when lamp 20 is operated in the dimming mode.

Turning now to FIG. 2, in a preferred embodiment of ballast 10, filament heating control circuit 400 comprises first and second electronic switches 420,430. During operation, first electronic switch 420 turns on and controls heating of lamp filaments 22,24 during the preheat mode. Second electronic switch 430 is operably coupled in parallel with first electronic switch 420. During operation, second electronic switch 430 turns on and controls heating of the filaments 22,24 during the dimming mode.

As described in FIG. 2, inverter 200 is preferably implemented as a driven half-bridge type inverter that includes a first inverter transistor 240, a second inverter transistor 280, and an inverter driver circuit 220. First inverter transistor 240 is coupled between first input terminal 202 and first output terminal 206. Second inverter transistor 260 is coupled between first output terminal 206 and second output terminal 208. Second input terminal 204 and second output terminal 208 are each coupled to a circuit ground 50. Inverter driver circuit 220 is coupled to first and second inverter transistors 240,260. During operation, inverter driver circuit 220 provides substantially complementary commutation of first and second inverter transistors 240, 260; that is, inverter driver circuit 220 turns first and second inverter transistors 240,260 on and off in such a way that, when first inverter transistor 240 is on, second inverter transistor 260 is off, and vice versa. Inverter driver circuit 220 may be implemented using any of a number of suitable half-bridge driver arrangements that are well known to those skilled in the art. Preferably, inverter driver circuit 220 may be realized using a L6570G half-bridge driver integrated circuit along with associated peripheral circuitry.

As described in FIG. 2, inverter driver circuit 220 includes a preheat control output 222. During operation, inverter driver circuit 220 provides a small positive voltage (e.g., +5 volts) at preheat control output 222 for a predetermined preheating period (having a duration of, e.g., 1 second) that commences following initial activation of inverter driver circuit 220 (which occurs within a short period of time after power is applied to ballast 10). Upon completion of the preheating period, the voltage at preheat control output 222 goes to a low level (e.g., 0 volts) and then remains at that low level until at least such time as power is removed and then reapplied to ballast 10.

As described in FIG. 2, inverter 200 preferably further includes a current-sensing resistor 280 that is interposed between second inverter transistor 260 and circuit ground 50. Correspondingly, inverter driver circuit 220 preferably further includes a current-sensing input 224 (labeled "Isense" in FIG. 2) that is coupled to current-sensing resistor 280. The function of current-sensing resistor 280 is to allow inverter driver circuit 220 to monitor the peak current that flows through inverter transistors 240,260; if the peak current attempts to exceed a predetermined limit (such as what may occur during a lamp fault condition), inverter driver circuit 220 modifies its operation (e.g., by shutting down or shifting to a higher operating frequency) in order protect inverter transistors 240,260, as well as other components within ballast 10, from being damaged due to excessively high currents.

As described in FIG. 2, output circuit 300 is preferably implemented as a series-resonant output circuit that includes a resonant inductor 310, a resonant capacitor 320, a direct current (DC) blocking capacitor 330, a first filament heating winding (312), and a second filament heating winding (314). Resonant inductor 310 is coupled between first output terminal 206 of inverter 200 and first output connection 302. Resonant capacitor 320 is coupled between first output connection 302 and second output terminal 208 of inverter 200. DC blocking capacitor 330 is coupled between fourth output connection 308 and second output terminal 208 of inverter 200. First filament heating winding 312 is coupled between first and second output connections 302,304. Second filament heating winding 314 is coupled between third and fourth output connections 306,308. As will be explained in further detail below in connection with a preferred structure for filament heating control circuit 400, first and second filament heating windings 312,314 provide voltages for heating first and second lamp filaments 22,24. Those voltages are controlled by filament heating control circuit 400.

Referring again to FIG. 2, a detailed preferred structure for filament heating control circuit 400 is described as follows. In a preferred embodiment of ballast 10, filament heating control circuit 400 comprises a first terminal 402, a second terminal 404, a third terminal 406, a first capacitor 410, a filament heating control winding 316, a second capacitor 416, a first electronic switch 420, and a second electronic switch 430. First terminal 402 is coupled to first output terminal 206 of inverter 200. Second terminal 404 is coupled to preheat control output 222 of inverter driver circuit 220. Third terminal 406 is coupled to dimming control circuit 500. First capacitor 410 is coupled between first terminal 402 and a first node 412. Filament heating control winding 316 is coupled between first node 412 and a second node 414, and is magnetically coupled to first and second filament heating windings 312,314 of output circuit 300. First electronic switch 420 is preferably realized by a N-channel field effect transistor (FET) having a drain 424 coupled to second node 414, a gate 422 coupled to second terminal 404, and a source 426 coupled to circuit ground 50. Second electronic switch 430 is preferably realized by a N-channel FET having a drain 434, a gate 432 coupled to third terminal 406, and a source 436 coupled to circuit ground. Finally, second capacitor 416 is coupled between second node 414 and drain 434 of second electronic switch 430.

Preferably, filament heating control circuit 400 further includes a fourth terminal 408 and a diode 440. Fourth terminal 408 is coupled to first input terminal 202 of inverter 200. Diode 440 has an anode 442 coupled to second node 414 and a cathode 444 coupled to fourth terminal 408.

During operation, diode 440 protects first electronic switch 420 from any damage due to excessive voltage (e.g., caused by transients that may occur across filament heating control winding 316) by ensuring that the voltage at the drain 424 of first electronic switch 420 is prevented from substantially exceeding the value of the DC supply voltage ($V_{DC}$) that is provided to inverter 200.

As described herein, filament heating control circuit 400 is especially well-suited for implementation within a so-called two light level ballast, such as that which is described in U.S. patent application Ser. No. 11/010,845 (titled "Two Light Level Ballast," filed on Dec. 13, 2004, and assigned to the same assignee as the present invention), the disclosure of which is incorporated herein by reference.

Preferred components for implementing filament heating control circuit 400 and relevant portions of output circuit 300 are described as follows:

Filament heating windings 312,314: 6 wire turns

Filament heating control winding 316: 155 wire turns, 40 millihenries

Capacitor 410: 2200 picofarads

Capacitor 416: 330 picofarads

FETs 420,430: ST1N60S5 (N-channel MOSFET)

Diode 440: FR124

The detailed operation of ballast 10 and filament heating control circuit 400 is now explained with reference to FIG. 2 as follows.

Shortly after power is initially applied to ballast 10, inverter driver circuit 220 turns on (at t=0) and begins to provide complementary commutation of inverter transistors 240,260 at a predetermined first drive frequency (e.g., 75 kilohertz) that is substantially higher than the natural resonant frequency of the series resonant circuit that comprises resonant inductor 310 and resonant capacitor 320. Correspondingly, the voltage applied across lamp 20 via output connections 302,304,306,308 will be insufficient to ignite lamp 20.

During the period $0<t<t_1$, ballast 10 will operate in what is hereinafter referred to as the preheat mode. During the preheat mode, inverter driver circuit 220 provides a small positive DC voltage (e.g., +5 volts) at preheat control output 222. The small positive DC voltage at preheat control output 222 is coupled, via terminal 404, to gate 422 of FET 420 and causes FET 420 to turn on and to remain on for the duration of the preheat mode. With FET 420 turned on, current flows from first inverter output terminal 206 to circuit ground 50 via the circuit path that includes terminal 402, capacitor 410, filament heating control winding 316, and FET 420. This current flow induces a voltage across filament heating control winding 316 that is magnetically coupled to first and second filament heating windings 312,314 in output circuit 300, thereby providing voltages across windings 312,314 for heating lamp filaments 22,24.

Preferably, ballast 10 is designed to provide, during the preheat mode, a filament heating voltage on the order of about 9 volts rms. The exact magnitude of the voltage provided across filament heating windings 312,314 during the preheat mode is determined by a number of parameters, including the DC input voltage ($V_{DC}$) supplied to inverter 200, the operating frequency of inverter 200 (as provided by inverter driver circuit 220), the capacitance of capacitor 410, and the number of wire turns of filament heating control winding 316 relative to the number of wire turns of filament heating windings 312,314.

Upon completion of the preheat mode at $t=t_1$, and in the absence of a dimming command at input connections 502, 504 of dimming control circuit 500, inverter driver circuit 220 causes the voltage at preheat control output 222 to go to a reduced level (i.e., about zero). Correspondingly, FET 420 turns off and remains off for about as long as the voltage at preheat control output 222 remains at the reduced level. With the preheat mode completed, inverter driver circuit 220 reduces its drive frequency to a second predetermined value (e.g., 45 kilohertz) that is close enough to the natural resonant frequency (of the series resonant circuit) such that sufficiently high voltage (e.g., 350 volts rms) is generated for igniting lamp 20. Subsequently, lamp 20 ignites and begins to operate in a normal full-light manner. During the period $t_1<t<t_2$, ballast 10 is operated in what is hereinafter referred to as the full-light mode. During the full-light mode, FETs 420,430 are both turned off. With FETs 420,430 both turned off, no current flows through filament heating control winding 316. Consequently, no voltage is coupled to filament heating windings 312,314 from filament heating control winding 316. Thus, during the full-light mode, lamp 20 operates without ballast 10 supplying energy for heating filaments 22,24.

If, at some later time (i.e., $t=t_2$), an appropriate dimming command is applied to input connections 502,504 of dimming control circuit 500, dimming control circuit 500 will respond by providing a low level DC voltage (e.g., +8 volts) at terminal 406 of filament heating control circuit 400. Consequently, FET 430 will turn on and remain on for about as long the dimming command is applied to dimming control circuit 500. At about the same time, although not explicitly described in FIGS. 1 and 2, dimming control circuit 500 interacts directly with inverter driver circuit 220 such that, when an appropriate dimming command is provided at input connections 502,504, dimming control circuit 500 sends an appropriate signal to inverter driver circuit 220 to effect dimming of lamp 20 (e.g., by increasing the inverter operating frequency to a suitable value, such as 53 kilohertz, which has the effect of reducing the current provided to lamp 20). Thus, during the period $t>t_2$, ballast 10 will operate in what is hereinafter referred to as the dimming mode, wherein lamp 20 is operated at a current level (e.g., 80 millamperes rms) that is substantially less than its rated normal operating current (e.g., 180 milliamperes rms).

During the dimming mode, with FET 430 turned on, current flows from first inverter output terminal 206 to circuit ground 50 via the circuit path that includes terminal 402, capacitor 410, filament heating control winding 316, capacitor 416, and FET 430. The current flow causes a voltage across winding 316 that is magnetically coupled to first and second filament heating windings 312,314 in output circuit 300, thereby providing voltages across windings 312,314 for heating lamp filaments 22,24.

Preferably, ballast 10 is designed to provide, during the dimming mode, a filament heating voltage on the order of about 6 volts rms. The magnitude of the voltage that is provided across filament heating windings 312,314 during the dimming mode is determined by a number of parameters, including the DC input voltage ($V_{DC}$) supplied to inverter 200, the operating frequency of inverter 200 (as provided by inverter driver circuit 220), the capacitances of capacitors 410,416, and the number of wire turns of filament heating control winding 316 relative to the number of wire turns of filament heating windings 312,314. Significantly, during the dimming mode, capacitors 410,416 are effectively connected in series (thus providing an increased effective series impedance, in comparison with what occurs during the preheat mode) that causes the filament heating voltage to be reduced in comparison with its value during the preheat mode.

In this way, ballast 10 provides an enhanced type of programmed start operation that accommodates dimming and that substantially preserves the useful operating life of lamp 20.

Although the present invention has been described with reference to certain preferred embodiments, numerous modifications and variations can be made by those skilled in the art without departing from the novel spirit and scope of this invention.

What is claimed is:

1. A ballast for powering at least one gas discharge lamp having first and second lamp filaments, the ballast comprising:

an inverter having first and second input terminals and first and second output terminals, wherein the second input terminal and the second output terminal are coupled to a circuit ground, the inverter including an inverter driver circuit having a preheat control output;

an output circuit coupled to the inverter output terminals, the output circuit having first, second, third, and fourth output connections adapted for connection to the at least one gas discharge lamp, wherein the first and second output connections are adapted for connection to the first lamp filament, and the third and fourth output connections are adapted for connection to the second lamp filament, the output circuit including a first filament heating winding coupled between the first and second output connections, and a second filament heating winding coupled between the third and fourth output connections;

a dimming control circuit having a pair of input connections adapted to receive a dimming control input; and a filament heating control circuit coupled to the dimming control circuit, the inverter, and the output circuit, the filament heating control circuit being operable such that:

(i) during a preheat mode that occurs prior to ignition of the lamp, the lamp filaments are heated at a first level;

(ii) during a full-light mode that occurs after ignition of the lamp, the lamp filaments are not heated, wherein the full-light mode includes operating the lamp at a current level that is substantially equal to a rated normal operating current of the lamp; and (iii) during a dimming mode that occurs after ignition of the lamp, the lamp filaments are heated at a second level, wherein the dimming mode includes operating the lamp at a current level that is substantially less than the rated normal operating current of the lamp; and wherein the filament heating control circuit includes: (i) a first electronic switch operably coupled to the first output terminal of the inverter, the preheat control output of the inverter driver circuit, and circuit ground, and operable, in response to a low level voltage at the preheat control output during the preheat mode, to turn on and control heating of the lamp filaments during the preheat mode; and (ii) a second electronic switch that operably coupled to the first output terminal of the inverter, the dimming control circuit, and circuit ground, and operable, in response to a low level voltage from the dimming control circuit during the dimming mode, to turn on and provide heating of the lamp filaments during the dimming mode.

2. The ballast of claim 1, wherein the filament heating control circuit further comprises:

a first terminal coupled to the first output terminal of the inverter;

a second terminal coupled to the preheat control output of the inverter driver circuit;

a third terminal coupled to the dimming control circuit;

a first capacitor coupled between the first terminal and a first node;

a filament heating control winding coupled between the first node and a second node, wherein the filament heating control winding is magnetically coupled to the first and second filament heating windings of the output circuit;

wherein the first electronic switch has a drain coupled to the second node, a gate coupled to the second terminal, and a source coupled to circuit ground;

wherein the second electronic switch has a drain, a gate coupled to the third terminal, and a source coupled to circuit ground; and a second capacitor coupled between the second node and the drain of the second electronic switch.

3. The ballast of claim 2, wherein the first and second electronic switches of the filament heating control circuit each comprise a N-channel field effect transistor.

4. The ballast of claim 2, wherein the filament heating control circuit further comprises:

a fourth terminal coupled to the first input terminal of the inverter; and a diode having an anode coupled to the second node and a cathode coupled to the fourth terminal.

5. The ballast of claim 2, wherein the inverter further comprises:

a first inverter transistor coupled between the first input terminal and the first output terminal;

a second inverter transistor coupled between the first output terminal and the second output terminal; and wherein the inverter driver circuit is coupled to, and operable to provide substantially complementary commutation of, the first and second inverter transistors.

6. The ballast of claim 2, wherein the output circuit further comprises:

a resonant inductor coupled between the first output terminal of the inverter and the first output connection;

a resonant capacitor coupled between the first output connection and the second output terminal of the inverter; and a direct current (DC) blocking capacitor coupled between the fourth output connection and the second output terminal of the inverter.

7. A ballast for powering at least one gas discharge lamp having first and second lamp filaments, the ballast comprising:

an inverter, comprising:

first and second input terminals adapted to receive a source of substantially direct current (DC) voltage;

first and second output terminals;

a first inverter transistor coupled between the first input terminal and the first output terminal;

a second inverter transistor coupled between the first output terminal and the second output terminal, wherein the second input terminal and the second output terminal are coupled to a circuit ground;

an inverter driver circuit coupled to, and operable to provide substantially complementary commutation of, the first and second inverter transistors, the inverter driver circuit including a preheat control output;

an output circuit coupled to the inverter output terminals, the output circuit comprising:

first, second, third, and fourth output connections adapted for connection to the at least one gas discharge lamp, wherein the first and second output connections are adapted for connection to the first lamp filament, and the third and fourth output connections are adapted for connection to the second lamp filament;

a resonant inductor coupled between the first output terminal of the inverter and the first output connection;

a resonant capacitor coupled between the first output connection and the second output terminal of the inverter;

a direct current (DC) blocking capacitor coupled between the fourth output connection and the second output terminal of the inverter;

a first filament heating winding coupled between the first and second output connections; and a second filament heating winding coupled between the third and fourth output connections;

a dimming control circuit having a pair of input connections adapted to receive a dimming control input; and a filament heating control circuit, comprising:

a first terminal coupled to the first output terminal of the inverter;

a second terminal coupled to the preheat control output of the inverter driver circuit;

a third terminal coupled to the dimming control circuit;

a first capacitor coupled between the first terminal and a first node;

a filament heating control winding coupled between the first node and a second node, wherein the filament heating control winding is magnetically coupled to the first and second filament heating windings of the output circuit;

a first electronic switch having a drain coupled to the second node, a gate coupled to the second terminal, and a source coupled to circuit ground;

a second electronic switch having a drain, a gate coupled to the third terminal, and a source coupled to circuit ground; and a second capacitor coupled between the second node and the drain of the second electronic switch.

8. The ballast of claim 7, wherein the first and second electronic switches of the filament heating control circuit each comprise a N-channel field effect transistor.

9. The ballast of claim 7, wherein the filament heating control circuit further comprises:

a fourth terminal coupled to the first input terminal of the inverter; and a diode having an anode coupled to the second node and a cathode coupled to the fourth terminal.

* * * * *